United States Patent [19]

Narushima et al.

[11] Patent Number: 4,669,906

[45] Date of Patent: Jun. 2, 1987

[54] BALL-POINT PEN VENTING ARRANGEMENT

[75] Inventors: Kunio Narushima, Tokyo; Toshikazu Shiobara, Honjo, both of Japan

[73] Assignee: Pilot Man-Nen -Hitsu Kabushiki Kaisha, Tokyo, Japan

[21] Appl. No.: 781,036

[22] Filed: Sep. 27, 1985

[30] Foreign Application Priority Data

Jun. 26, 1985 [JP] Japan ..... 60-97135[U]

[51] Int. Cl.[4] ..... B43K 7/08; B43K 7/00

[52] U.S. Cl. ..... 401/209; 401/135; 401/199; 401/217

[58] Field of Search ..... 401/199, 135, 134, 133, 401/209, 217

[56] References Cited

U.S. PATENT DOCUMENTS

| | | | |
|---|---|---|---|
| 2,870,742 | 1/1959 | Hackmyer | 401/135 |
| 3,362,778 | 1/1968 | Pavese | 401/135 X |
| 3,554,658 | 1/1971 | Malm et al. | 401/199 |
| 4,209,263 | 6/1980 | Droubay | 401/199 X |

FOREIGN PATENT DOCUMENTS

| | | | |
|---|---|---|---|
| 2745608 | 4/1979 | Fed. Rep. of Germany | 401/209 |

*Primary Examiner*—Steven A. Bratlie

*Attorney, Agent, or Firm*—Wenderoth, Lind & Ponack

[57] ABSTRACT

A ball-point pen for water-soluble ink having a barrel with a vent hole, a cylindrical ink reservoir covered except at its exposed front and rear ends, and an ink feed core for supplying ink from the reservoir to a ball at the pen writing tip is provided with a hollow inner cover member comprising a cylindrical holding part for covering and holding a relatively long front portion of the reservoir and a cylindrical shielding part for partitioning the front exposed part of the reservoir and the feed core from the vent hole, the inner cover member being secured within the barrel by press-fitting the front end of the shielding part into a bore of the front end part of the barrel. Passages are provided for communication between the vent hole and the rear exposed end of the reservoir. Leakage of ink due to causes such as temperature change and impact force imparted to the barrel in the longitudinal direction thereof is thereby prevented. A tip holding member holding therein a ball point holder is press-fitted into a bore of the barrel front end part. A rear plug is also press-fitted into the barrel.

4 Claims, 3 Drawing Figures

BALL-POINT PEN VENTING ARRANGEMENT

BACKGROUND OF THE INVENTION

This invention relates generally to ball-point pens for writing with aqueous or water-soluble inks. More particularly, the invention relates to improvements in a ball-point pen for water-soluble inks of a simple and inexpensive construction by which, within the barrel of the pen, evaporation and leakage of ink from an ink reservoir and/or an ink feed core are prevented.

The type of ball-point pen with which this invention is concerned uses a water-base or water-soluble ink of high volatility and excellent fluidity. It has been customary, in a ball-point pen of this type, to provide some kind of shielding means between a vent hole and an ink reservoir or an ink feed core for conducting ink therefrom to a ball socket part for reasons arising from the position of the vent hole.

More specifically, many of the ball-point pens for water-soluble inks of this character have been of the cap type in order to assure airtightness within the pen barrel when the pen is not in the state of writing. Accordingly, the vent hole, which communicates with the ink reservoir is ordinarily formed through the wall of the barrel at its front end part. Furthermore, since the front end part of the ink reservoir, in which an ink feed core is imbedded, is exposed, leakage of the ink within the ink reservoir into the interior of the barrel is caused by an unbalanced state occurring between the pressure within the ink reservoir and outside pressure as a result of temperature variation or by some impact applied to the pen when it is assuming an orientation with its ball point holder pointed downward. Eventually, this ink which has thus leaked further leaks out of the barrel through the vent hole.

Various measures and structural means for preventing this result have been proposed. However, these proposals have entailed complicated or high-cost solutions. Furthermore, difficulties have been encountered in the practical application of these proposals to automatic assembly processes for the production of writing instruments of this character. These processes have recently been attracting much attention among the manufacturers.

The use of effective automatic assembly processes for the production of writing instruments of this character requires simplicity in the construction of the instruments. This is generally incompatible with expedience and reliability in practical use of the writing instruments. When consideration is given to adaptability to effective automatic assembly processes, expedience and reliability are sacrificed, while if consideration is given to expedience and reliability, adaptability to automatic assembly processes is impaired. These results are due to the complicated construction of the writing instruments.

SUMMARY OF THE INVENTION

This invention seeks to provide a ball-point pen for water-soluble inks of a leakage-preventing construction which has ample shielding effectiveness with respect to the vent hole and, at the same time, may be readily manufactured by the above mentioned automatic assembly processes.

A characteristic feature of the ball-point pen of this invention is the provision of a hollow inner cover member comprising an ink reservoir holding part for covering and holding the outer surface of a considerably long front part of an ink reservoir and a shielding part for shielding the front part of the ink reservoir and an ink feed core from a vent hole formed through the side wall of the pen barrel thereby to shut off communication between the ink reservoir and the vent hole. The inner cover member is held in an assembled state within the barrel with the outer surface of the front portion of its shielding part affixed to the inner surface of the front end part of the barrel. The vent hole communicates through passages with the rear end part of the ink reservoir. By this structural arrangement, the aforementioned problems of the prior art can be solved as described hereinafter.

The nature, utility, and further features of this invention will be more clearly apparent from the following detailed description with respect to a specific embodiment of the invention when read in conjunction with the accompanying drawing, briefly described below.

DRAWING

DETAILED DESCRIPTION OF THE INVENTION

Throughout the disclosure, directional terms "front" and "forward" indicate the direction toward the writing end of the pen, while "rear" indicates the opposite direction.

Figure 1:
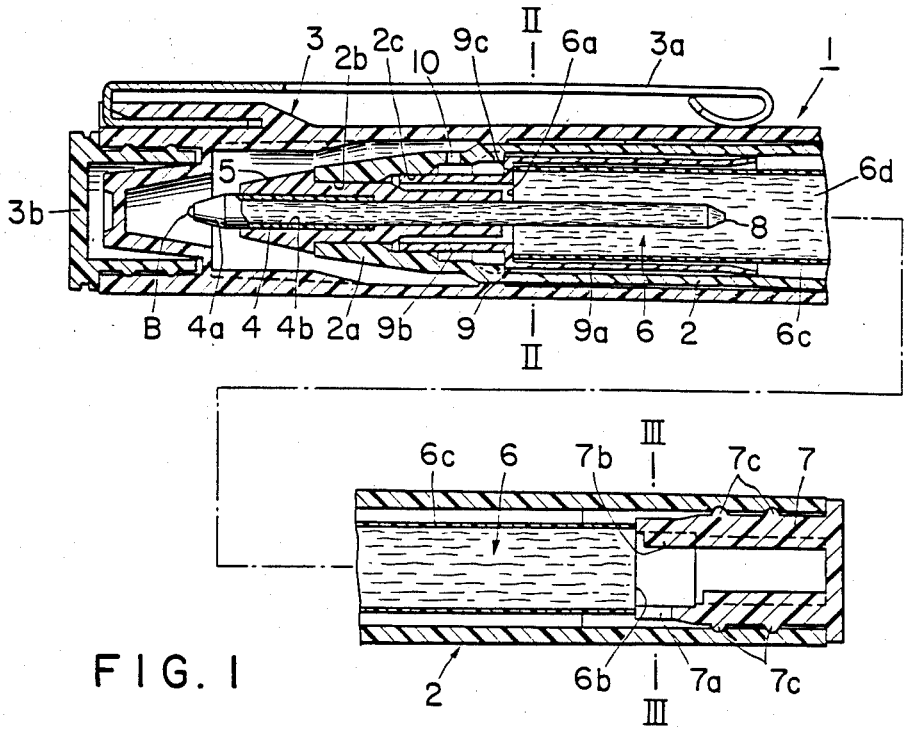
FIG. 1 is a side view in longitudinal section of the ball-point pen according to the invention.

As in the case of a conventional ball-point pen, the outer structure of the pen 1 of this invention illustrated in FIG. 1 comprises a case or barrel 2 and a cap 3 detachably fittable onto either end of the barrel 2. The cap 3 has a clip 3*a* and an ink color indicator 3*b* at the top.

The barrel 2 has a forwardly converging front end part 2*a*, in which is coaxially secured a tubular ball point holder 4. While the ball point holder 4 may be thus secured in any suitable manner, it is secured to the end part 2*a* by way of a hollow tip holding member 5 securely fitted coaxially into the front end of the end part 2*a* of the barrel 2 in the illustrated embodiment. More specifically, the ball point holder 4 is tightly fitted into the tip holding member 5 made of a synthetic resin material, which in turn is press-fitted into a bore 2*b* of the barrel front end part 2*a*. This constructional feature, wherein the ball point holder 4 is mounted by way of the holding member 5 of resin material affords the advantages of a positive fit and expedience in fitting.

Within the barrel 2 and to the rear of the holding member 5 is disposed an ink reservoir 6 comprising a cylindrical wad 6*d* of fibers, an ink absorbed in the fibrous wad, and a suitable sheath 6*c* covering the cylindrical outer surface of the fibrous wad 6*d* between its exposed front end 6*a* and its exposed rear end 6*b*. The rear end of the barrel 2 is closed by a rear plug 7 which at its front end abuts against the rear end 6*b* of the ink reservoir 6. The rear plug 7 and related parts are described in detail hereinafter.

The rear half part of an ink feed core 8 is coaxially imbedded in the front part of the ink reservoir 6 through the front end 6*a* thereof. The remaining front part of the ink feed core 8 extends forward through the bore at the rear part of the holding member 5 and completely through the hollow interior, constituting an ink feed core holding bore 4*b*, of the ball point holder 4 to the tip part 4*a* thereof holding a ball B. The ink feed core 8 functions to induce supply of ink to the tip part 4*a* from the ink reservoir 6.

A considerably long front part of the ink absorbent reservoir 6, enclosed in the sheath 6*c*, is fitted in and held by an ink reservoir holding part 9*a* of a hollow inner cover member 9, which comprises the holding part 9*a* of hollow cylindrical shape, a shielding part 9*b* also of hollow cylindrical shape but of smaller diameter, and an annular stepped or shoulder ledge 9*c* coaxially joining the holding part 9*a* and the shielding part 9*b*. The holding part 9*a* of this inner cover member 9 thus functions cooperatively with the aforementioned rear plug 7 abutting against the rear end 6*b* of the ink reservoir 6 to positively hold the ink reservoir in its proper position.

An important feature of this invention is the construction of the pen interior, particularly that of the hollow inner cover member 9, wherein its shielding part 9*b* is press-fitted into, and firmly secured to a bore 2*c* of the front end part 2*a* of the barrel 2, whereby the inner cover member 9 is securely held within and relative to the barrel 2. The shielding part 9*b* functions to partition a vent hole 10 formed in the side wall of the barrel front end part 2*a* from the exposed surface of the front end 6*a* of the ink reservoir 6 and from the ink feed core 8, thereby shutting off communication therebetween.

Figure 3:
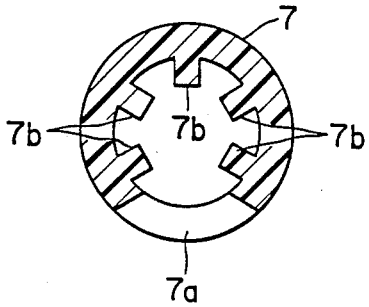
FIG. 3 is a cross section taken along the plane indicated by line III—III in FIG. 1 of a rear plug.

The aforementioned rear plug 7 is of hollow cylindrical shape with an open front end and a closed rear end having a flange for contacting the rear extremity of the barrel 2 and is press-fitted into the rear end of the barrel 2. This rear plug 7 is provided around its outer cylindrical surface with spaced-apart annular ridges 7*c*, which assure an airtight seal between the plug 7 and the barrel 2. The rear plug 7 at its front end abuts against the rear end 6*b* of the ink reservoir 6 and the rear end of the sheath 6*c* and has a cutout slot 7*a* communicating through the interior of the barrel 2 with the aforementioned vent hole 10. As shown in FIG. 3, a plurality of projections 7*b*, projecting radially inward toward the centerline of the plug 7, are formed with suitable spacing around the front end of the rear plug 7.

Thus, the rear end 6*b* of the ink reservoir 6 abutting against these projections 7*b* is communicative via the cutout slot 7*a* with the vent hole 10. The plurality of the projections 7*b* at the front end of the rear plug 7 serves to prevent undesirable changes arising from impact force applied to the pen in its axial direction, such as deformation of the rear end 6*b* of the ink reservoir, that is, slippage between the body of fibers constituting the ink reservoir 6 and the sheath 6*c*.

Figure 2:
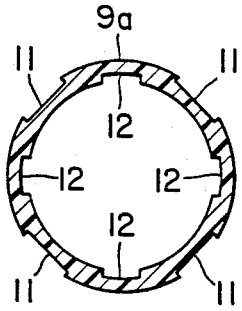
FIG. 2 is a cross section taken along the plane indicated by line II—II in FIG. 1, with some parts deleted, and showing grooves on the outer and inner surfaces of a hollow inner cover member.

The aforementioned ink reservoir holding part 9*a* of the inner cover member 9 is, as shown in FIG. 2, provided around its outer and inner cylindrical surfaces with outwardly facing grooves 11 and inwardly facing grooves 12, respectively, extending in the longitudinal direction of the pen. The outer grooves 11 serve as passageways for communicating the vent hole 10 with the rear end 6*b* of the ink reservoir 6, while the inner grooves 12 facilitate the insertion of the ink reservoir 6 into the barrel 2 and the holding of the reservoir in the barrel. That is, in the assembly work in the automatic assembly process described in detail hereinafter, resistance due to compression of air which may arise during the insertion of the ink reservoir 6 into the barrel 2 is eliminated, and, at the same time, suitable gripping of the outer cylindrical surface of the ink reservoir 6 is afforded.

As described hereinbefore, the inner cover member 9 functions to cover and hold the outer cylindrical surface of the front portion of the ink reservoir 6 and, at the same time, to shield the front portion of the ink reservoir 6 and the ink feed core 8 from the vent hole 10. Therefore, even if an abnormal ink leakage into the interior of the barrel 2 should occur, leakage of this ink out through the vent hole 10 is positively prevented.

Also as described hereinbefore, this inner cover member 9 is fitted in and secured within the barrel 2 by the press-fit of the outer surface of its shielding part 9*b* into the bore 2*c* of the barrel front end part 2*a*. Accordingly, a considerable space is afforded within the shielding part 9*b*, whereby, in comparison with the construction generally adopted hitherto wherein a shielding member of this character is secured directly to a ball point holder or its supporting member, the degree of freedom in the securing of the ball point holder 4 to the barrel front end part 2*a* is increased, and the applicability of this construction according to this invention to the aforementioned automatic assembly process is remarkably improved.

The adaptability of the water-soluble ink, ball-point pen according to this invention to the automatic assembly process will now be considered more fully. A considerable space can be obtained as mentioned above within the shielding part 9*b* of the hollow inner cover member 9, whereby the ball point holder 4 can be made to assume an independent state relative to the hollow inner cover member 9 during the assembly and securing of the ball point holder 4 including the ink feed core 8. Accordingly, this assembly and securing process can be carried out safely and rapidly as a matter of course.

Above all, however, the greatest advantage gained is that, in a series of processing and assembling processes, it is not necessary to resort to a work mode wherein the ball part is continually disposed downward, as can be seen in corresponding processes for known pens wherein the shielding part is directly secured to and supported by the ball point holder or its holding member. This is because natural downward flow of ink due to gravity or impact force in the axial direction can be prevented.

A general outline of the steps of emplacement and attachment of various parts in the barrel 2 in one example of an automatic assembly process adapted to the ball-point pen of this invention is as follows.

First, the hollow inner cover member 9 is fitted into the barrel 2 from its open rear end without the rear plug 7 and attached in place. This is done by press-fitting the shielding part 9*b* of the member 9 into the bore 2*c* of the barrel front end part 2*a*. Then the ink reservoir 6 in its sheath 6*c* is also inserted into the barrel 2 through its open rear end until the front portion of the ink reservoir 6 is inserted into the holding part 9*a* of the inner cover member 9, and the front end 6*a* of the reservoir 6 abuts against the stepped ledge 9*c*. The rear end of the barrel 2 is then closed by fitting the rear plug 7 thereinto. The tip holding member 5 is thereafter inserted and press-fitted rearwardly into the bore 2*b* of the barrel front end part 2*a*, whereby the ball point holder 4 with the ink feed core 8 fitted therein is attached in place and the rear portion of the ink feed core 8 is forcibly imbedded in the front part of the ink reservoir 6 through the front end 6*a* thereof.

In this example the fitting of the ball point holder 4 together with the tip holding member 5 is carried out last. Accordingly, there is no necessity of fitting the inner cover member 9 securely to the ball point holder 4. Even if the ball point holder 4 is assembled in place previously, it is possible to carry out the subsequent assembling process as the ball point holder 4 is held in an upwardly directed state without imparting any adverse effect on other work. Therefore, in the aforedescribed example, the steps of assembling the inner cover member 9 and the ink reservoir 6 may be carried out after the ball point holder 4 has been assembled in place.

When the latter step of the insertion of the inner cover member 9 and the ink reservoir 6 is carried out, the inwardly facing grooves 12 of the inner cover member 9 have a particularly effective function as described hereinbefore.

Thus, as will be apparent from the foregoing description, this invention provides a ball-point pen for water-soluble ink, which is advantageous in that, by the provision of a hollow inner cover member of a very simple construction, which can be formed as an integral structure, leaking of ink through the vent hole arising from various causes can be prevented inexpensively and positively. Also, because the hollow inner cover member is securely held within the barrel as a result of its shielding part being press-fitted into the bore of the barrel front part, a considerable space is obtained within the shielding part.

It will be noted further that since all of the hollow inner cover member, the ink reservoir, the rear plug and the ball point holder including the tip holding member can be assembled into the pen barrel by the same axial movement, automatic assembly of the pens can be carried out easily. Moreover, the use of press-fitting of the inner cover member, the rear plug and the tip holding member into the barrel is advantageous in making the automatic assembly easier and simpler.

What is claimed is:

1. A ball-point pen for water-soluble ink, comprising:

a barrel (2) having a vent hole (10) formed through the side wall of a front end part (2*a*) of the barrel, said front end part (2*a*) having therethrough a foremost first longitudinal bore (2*b*) and a second longitudinal bore (2*c*) disposed rearwardly of said first bore and of greater diameter than said first bore, said vent hole (10) disposed rearwardly of the second bore (2*c*);

an ink absorbing sheathed ink reservoir (6) accommodated within said barrel and having a front portion including an open front end (6*a*) and having an open rear end (6*b*);

a ball point holder (4) holding an ink feed core (8), said ink feed core (8) having a ball (B) at its front end and press fitted in said first bore (2*b*) so as to be affixed to the front end of the barrel, said ink feed core (8) connected to the ink reservoir (6) and the ball point holder (4) for supplying ink from the ink reservoir to the ball;

a hollow inner cover member (9) having a cylindrical ink reservoir holding part (9*a*) fitted within the barrel (2) and to the outer surface of the front portion of the ink reservoir (6), said ink reservoir holding part (9*a*) having longitudinal grooves (12) in the inner surface thereof, said inner cover member (9) also having a cylindrical shielding part (9*b*) extending forwardly from the ink reservoir holding part (9*a*) for surrounding said ink feed core (8) and providing an annular space defined therebetween, said annular space communicating with the open front end (6*a*) of the ink reservoir (6), said shielding part (9*b*) being of a smaller diameter than the ink reservoir holding part (9*a*), said inner cover member having a shoulder (9*c*) located between the ink reservoir holding part (9*a*) and the shielding part (9*b*) and abutting the front end (6*a*) of the ink reservoir (6) for positioning the latter relative to the inner cover member (9), said shielding part (9*b*) press-fitted at its front end into said second bore (2*c*) for shielding the open front end (6*a*) of the ink reservoir (6) and the ink feed core (8) from the vent hole (10) thereby to shut off communication therebetween, and longitudinal groove means (11) in the outer surface of the ink reservoir holding part (9*a*) for providing an air passage means within the barrel for communication of the vent hole (10) with the rear end (6*b*) of the ink reservoir.

2. A ball-point pen as claimed in claim 1 wherein said barrel (2) has in the inner surface thereof shoulder means which abuts against said shoulder (9*c*) of the inner cover member (9) for positioning the latter relative to the barrel.

3. A ball-point pen as claimed in claim 1 wherein a rear plug is press-fitted in the rear end part of the barrel.

4. A ball-point pen as claimed in claim 3 wherein the rear plug abuts against the rear end of the ink reservoir to hold the reservoir in place between the inner cover member and the rear plug.

* * * * *